US009446607B2

(12) United States Patent
Atwood et al.

(10) Patent No.: US 9,446,607 B2
(45) Date of Patent: Sep. 20, 2016

(54) SPACER WITH INTEGRAL FLANGE FOR PRINT HEAD PROTECTION

(71) Applicant: XEROX CORPORATION, Norwalk, CT (US)

(72) Inventors: Christopher Douglas Atwood, Webster, NY (US); Mark A. Adiletta, Fairport, NY (US); Elizabeth Marie Fischer, Albion, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/489,952

(22) Filed: Sep. 18, 2014

(65) Prior Publication Data

US 2016/0082756 A1 Mar. 24, 2016

(51) Int. Cl.

| | |
|---|---|
| ***B41J 23/00*** | (2006.01) |
| ***B41J 11/00*** | (2006.01) |
| ***B41J 2/155*** | (2006.01) |
| *B41J 2/14* | (2006.01) |

(52) U.S. Cl.

CPC ..... *B41J 11/0045* (2013.01); *B41J 2/1433* (2013.01); *B41J 2/155* (2013.01); *B41J 2002/14443* (2013.01); *B41J 2202/11* (2013.01)

(58) Field of Classification Search

CPC . B41J 11/0005; B41J 11/0045; B41J 11/005; B41J 11/0055

USPC ..... 347/37

See application file for complete search history.

(56) References Cited

U.S. PATENT DOCUMENTS

| | | | | |
|---|---|---|---|---|
| 5,065,169 | A * | 11/1991 | Vincent et al. | 347/8 |
| 5,478,163 | A * | 12/1995 | Flugge et al. | 400/645 |
| 5,534,902 | A * | 7/1996 | Hoesly | 347/104 |
| 5,993,094 | A * | 11/1999 | Lee | 400/625 |
| 6,679,578 | B2 * | 1/2004 | Arakawa | B41J 2/16547 347/33 |
| 7,699,417 | B2 * | 4/2010 | Inoue | B41J 11/002 347/20 |
| 7,942,493 | B2 * | 5/2011 | Watanabe | 347/19 |
| 8,011,779 | B2 * | 9/2011 | Matsuhashi | B41J 11/002 347/102 |
| 8,317,297 | B2 * | 11/2012 | Terada | 347/37 |
| 8,403,454 | B2 * | 3/2013 | Kitamura | B41J 2/16532 347/29 |
| 8,636,337 | B2 * | 1/2014 | Shinoda | B41J 2/16505 347/22 |
| 8,702,227 | B2 * | 4/2014 | Samoto | 347/104 |
| 8,714,734 | B2 * | 5/2014 | Sugitani | 347/104 |
| 8,944,561 | B2 * | 2/2015 | Sugiura | B41J 2/165 347/29 |
| 9,010,904 | B2 * | 4/2015 | Nukui | B41J 2/165 347/29 |
| 2005/0024424 | A1 * | 2/2005 | Murayama | 347/30 |
| 2007/0229611 | A1 * | 10/2007 | Nagashima | B41J 2/175 347/84 |
| 2015/0124033 | A1 * | 5/2015 | Lo et al. | 347/104 |

FOREIGN PATENT DOCUMENTS

WO WO 2014003719 A1 * 1/2014

* cited by examiner

*Primary Examiner* — Jannelle M Lebron

*Assistant Examiner* — Jeremy Bishop

(74) *Attorney, Agent, or Firm* — MH2 Technology Law Group LLP

(57) ABSTRACT

A printer including a print head, a transport belt, and a spacer. The print head may include a plurality of jets configured to eject ink. The transport belt may be positioned below the print head. The spacer may be positioned above the transport belt. The spacer may include a first surface, and a distance between a portion of the first surface and the transport belt may decrease moving in the direction that the transport belt moves.

19 Claims, 5 Drawing Sheets

SPACER WITH INTEGRAL FLANGE FOR PRINT HEAD PROTECTION

TECHNICAL FIELD

The present teachings relate generally to printers and, more particularly, to systems and methods for preventing damage to the print head of a printer.

BACKGROUND

A print head of a printer includes a face plate through which ink is ejected onto a medium (e.g., paper). The face plate may include a coating that helps to form the ink droplets as they are ejected. As the paper moves through the printer, a gap exists between the paper and the face plate that is from about 0.5 mm to about 1.0 mm. This small distance may help to ensure that the ink lands on the desired portion of the paper. However, when the paper is not flat or smooth, the paper may extend (e.g., upward) through this distance and contact the face plate. For example, the paper may have one or more sides or corners curled up, or the paper may be cockled.

The paper may disturb or remove a portion of the coating when the paper contacts the face plate. In other embodiments, the paper may damage the structure of the face plate. What is needed, therefore, is an improved system and method for preventing damage to the print head of a printer.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

A printer is disclosed. The printer may include a print head, a transport belt, and a spacer. The print head may include a plurality of jets configured to eject ink. The transport belt may be positioned below the print head. The spacer may be positioned above the transport belt. The spacer may include a first surface, and a distance between a portion of the first surface and the transport belt may decrease moving in the direction that the transport belt moves.

In another embodiment, the printer may include a print head including a plurality of jets configured to eject ink. The transport belt may be positioned below the print head. The spacer may be positioned above the transport belt. The spacer may include a first side positioned upstream from the jets and a second side positioned downstream from the jets with respect to the direction that the transport belt moves. The first side may include a first surface, and a distance between a portion of the first surface and the transport belt may decrease moving in the direction that the transport belt moves.

A method for printing is also disclosed. The method may include causing a piece of paper to be placed onto a transport belt in a printer. The transport belt may move in a direction in the printer. The printer may include a print head and a spacer. The print head may include a plurality of jets configured to eject ink, and the transport belt may be positioned below the print head. The spacer may be positioned above the transport belt. The spacer may include a first surface, and a distance between a portion of the first surface and the transport belt may decrease moving in the direction that the transport belt moves.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same, similar, or like parts.

As used herein, unless otherwise specified, the word "printer" encompasses any apparatus that performs a print outputting function for any purpose, such as a digital copier, bookmaking machine, facsimile machine, a multi-function machine, electrostatographic device, 3D printer that can make a 3D objects, etc. It will be understood that the structures depicted in the figures may include additional features not depicted for simplicity, while depicted structures may be removed or modified.

Figure 1:
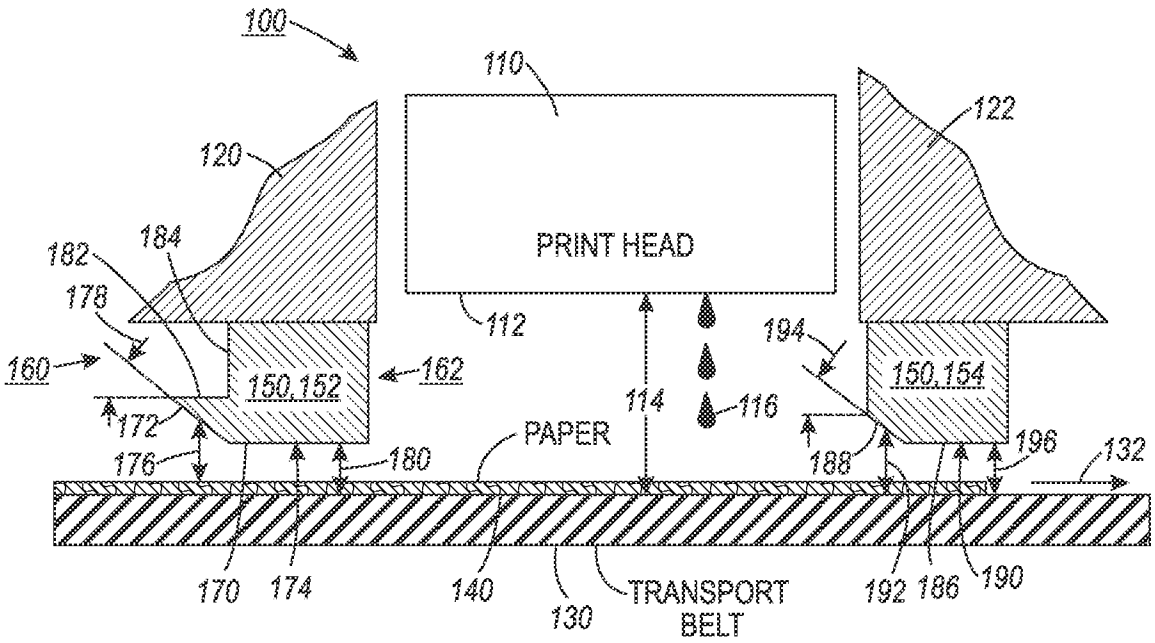
FIG. 1 depicts a cross-sectional view of a print head and an illustrative spacer in a printer, according to one or more embodiments disclosed.

FIG. 1 depicts a cross-sectional view of a print head 110 and an illustrative spacer 150 in a printer 100, according to one or more embodiments disclosed. The print head 110 may be positioned between two mounting plates 120, 122. The mounting plates 120, 122 may suspend the print head 110 above a transport belt 130. The print head 110 may include a face plate 112 that "faces" downward toward the transport belt 130. A distance 114 between the face plate 112 and the transport belt 130 may be from about 0.2 mm to about 0.5 mm, about 0.5 mm to about 1.0 mm, or about 1.0 mm to about 3.0 mm.

The transport belt 130 may be positioned below or beneath the print head 110 and the mounting plates 120, 122. The transport belt 130 may be configured to move in a direction 132 that is parallel to the surface of the face plate 112. Accordingly, a piece of paper 140 on the transport belt 130 may be configured to move in the direction 132. As the paper 140 moves under the print head 110, ink 116 may be ejected from the print head 110 through a plurality of jets (shown in FIG. 2) in the face plate 112.

A spacer 150 may be positioned above the transport belt 130. The spacer 150 may be coupled to or integral with the mounting plates 120, 122. The spacer 150 may be positioned between the mounting plates 120, 122 and the transport belt 130. The spacer 150 may include a first side 152 and a second side 154. The print head 110 may be positioned between the first and second sides 152, 154.

The first side 152 of the spacer 150 may include an "upstream" side 160 and a "downstream" side 162, where upstream and downstream are determined based upon the direction 132 that the transport belt 130 moves. The first side 152 of the spacer 150 may include a first surface 170 that extends between the upstream and downstream sides 160, 162 and faces the transport belt 130. The first surface 170 may include a sloped portion 172 and a parallel portion 174.

The sloped portion 172 may ramp or slant toward the transport belt 130 moving in the direction 132. More particularly, a distance 176 between the sloped portion 172 and the transport belt 130 may decrease moving in the direction 132. As such, the sloped portion 172 may be oriented at an angle 178 with respect to the transport belt 130. The angle 178 may be from about 10° to about 80°, about 20° to about 70°, or about 30° to about 60°. Although shown as planar, in another embodiment, the sloped portion 172 may be curved such that the distance 176 between the sloped portion 172 and the transport belt 130 may decrease moving in the direction 132.

The parallel portion 174 may be downstream from the sloped portion 172. The parallel portion 174 may be substantially parallel to the transport belt 130. As used herein, the term "substantially" allows for a tolerance of +/−10°. A distance 180 between the parallel portion 174 and the transport belt 130 may be from about 0.1 mm to about 0.6 mm or about 0.2 mm to about 0.4 mm. Thus, the shortest distance 180 between the spacer 150 (e.g., the parallel portion 174) and transport belt 130 may less than or equal to 60%, less than or equal to 50%, or less than or equal to 40% of the distance 114 between the print head 110 (e.g., the face plate 112) and the transport belt 130.

In at least one embodiment, the distance 180 may be adjustable within the printer 100. For example, the distance 180 may be adjustable depending, at least partially, on the thickness of the paper 140, the humidity in the air and/or paper, and whether the paper 140 has already received ink 116 on one side and is passing back through for duplex printing.

In another embodiment, the spacer 150 may be configured to be raised (e.g., away from the transport belt 130) with respect to the print head 110. In another embodiment, the print head 110 may be configured to be lowered (e.g., toward the transport belt 130) with respect to the spacer 150. This may allow the surfaces 112, 174 to become substantially aligned. This may enable the surface 112 of the print head 110 to be more easily wiped or cleaned. It may also allow for easier capping of the print head 110, if desired.

The first side 152 of the spacer 150 may also include a second surface 182 that is positioned between the first surface 170 and the mounting plate 120. The second surface 182 may be connected to the first surface 170 and extend therefrom in the direction 132. As shown, the second surface 182 is substantially parallel to the transport belt 130. In another embodiment, the second surface 182 may be sloped toward the mounting plate 120 moving in the direction 132. More particularly, a distance between the second surface 182 and the mounting plate 120 may decrease moving in the direction 132. As discussed in more detail below, the second surface 182 may serve as a "shoulder" that prevents bent or cockled pieces of paper 140 from passing under and potentially damaging the print head 110.

The first side 152 of the spacer 150 may also include a third surface 184 that is positioned between the second surface 182 and the mounting plate 120. As shown, the third surface 184 may be substantially perpendicular to the transport belt 130.

The second side 154 of the spacer 150 may include a first surface 186. The first surface 186 may include a sloped portion 188 and a parallel portion 190. The sloped portion 188 may ramp or slant toward the transport belt 130 moving in the direction 132. More particularly, a distance 192 between the sloped portion 188 and the transport belt 130 may decrease moving in the direction 132. As such, the sloped portion 188 may be oriented at an angle 194 with respect to the transport belt 130. The angle 194 may be from about 10° to about 80°, about 20° to about 70°, or about 30° to about 60°.

The parallel portion 190 may be downstream from the sloped portion 188. The parallel portion 190 may be substantially parallel to the transport belt 130. A distance 196 between the parallel portion 190 and the transport belt 130 may be from about 0.1 mm to about 0.6 mm or about 0.2 mm to about 0.4 mm. In at least one embodiment, the sloped portion 188 may be omitted, leaving only the parallel potion 190.

Figure 2:
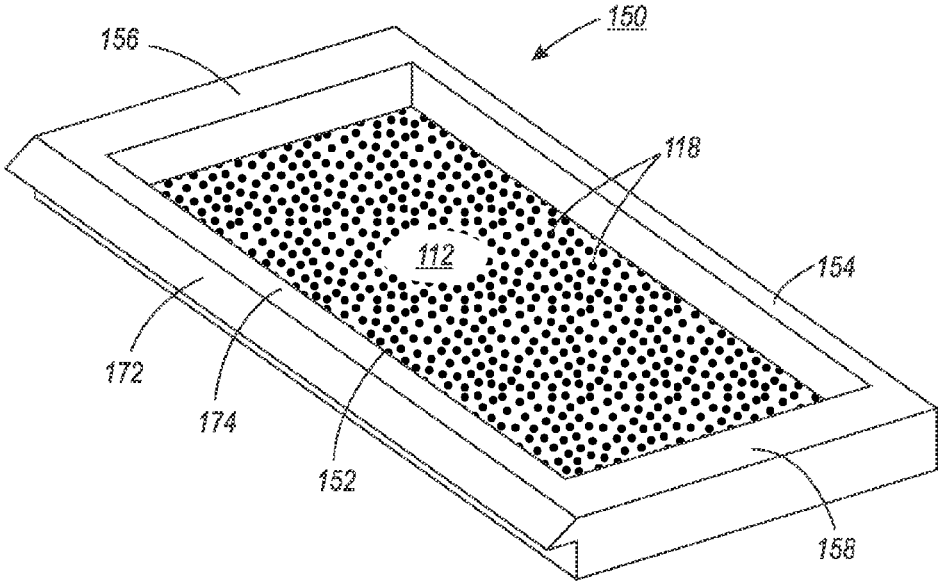
FIG. 2 depicts a perspective view of the spacer shown in FIG. 1 looking up through the spacer at the print head, according to one or more embodiments disclosed.

FIG. 2 depicts a perspective view of the spacer 150 shown in FIG. 1 looking up through the spacer 150 at the face plate 112 of the print head 110, according to one or more embodiments disclosed. In addition to the first and second sides 152, 154, the spacer 150 may also include third and fourth sides 156, 158 that are substantially perpendicular to the first and second sides 152, 154. Thus, the spacer 150 may form a rectangular shape having an inner area that is open or hollow. The face plate 112 of the print head 110 may include a plurality of jets 118. The ink may be ejected through the jets 118 and pass through the open area of the spacer 150 onto the paper (FIG. 1).

Figure 3:
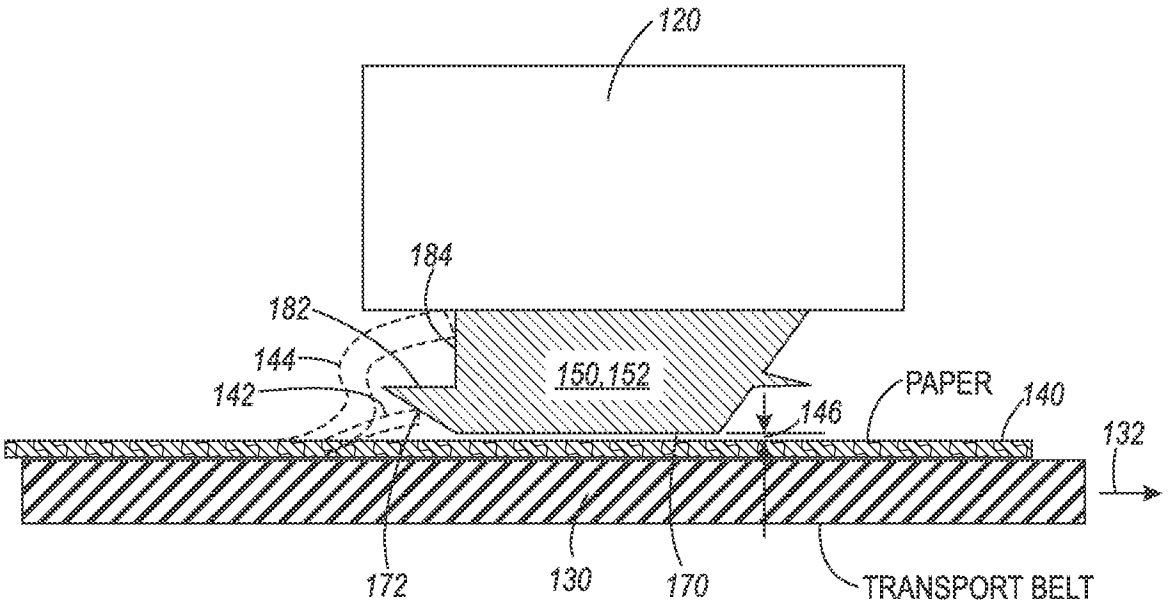
FIG. 3 depicts a cross-sectional view of the spacer preventing a piece of paper that is not smooth from passing through to the print head, according to one or more embodiments disclosed.

FIG. 3 depicts a cross-sectional view of the spacer 150 preventing a piece of paper 144 that is not smooth from passing through to the print head 110, according to one or more embodiments disclosed. Three pieces of paper 140, 142, 144 are shown in FIG. 3. The first piece of paper 140 is flat and smooth. As shown, the first piece of paper 140 may travel along the transport belt 130 in the direction 132 and pass under the spacer 150. The first piece of paper 140 may have no contact with the spacer 150. In fact, a gap 146 from about 10 μm to about 1000 μm, or more, may exist between the first piece of paper 140 and the first surface 170 of the spacer 150.

The second piece of paper 142 may be bent upward slightly. More particularly, a portion of the second piece of paper 142 may extend upward from the transport belt 130 a predetermined distance such that the second piece of paper 142 contacts the sloped portion 172 of the first surface 170 of the spacer 150. The predetermined distance may be from, on average, vertically halfway between surfaces 174 and 182. The contact with the sloped portion 172 may push the bent portion of the second piece of paper 142 back toward the transport belt 130.

The third piece of paper 144 may include a larger bend. More particularly, a portion of the third piece of paper 144 may extend upward from the transport belt 130 more than the predetermined distance such that the third piece of paper 144 contacts the second surface 182 and/or third surface 184 of the spacer 150. When this occurs, the third piece of paper 144 may become jammed between the mounting plate 120 and the spacer 150 or between the spacer 150 and the transport belt 130. While this may require a user to manually remove the third piece of paper 144 from the printer 100, the third piece of paper 144 is prevented from contacting and damaging the print head 110.

Figure 4:
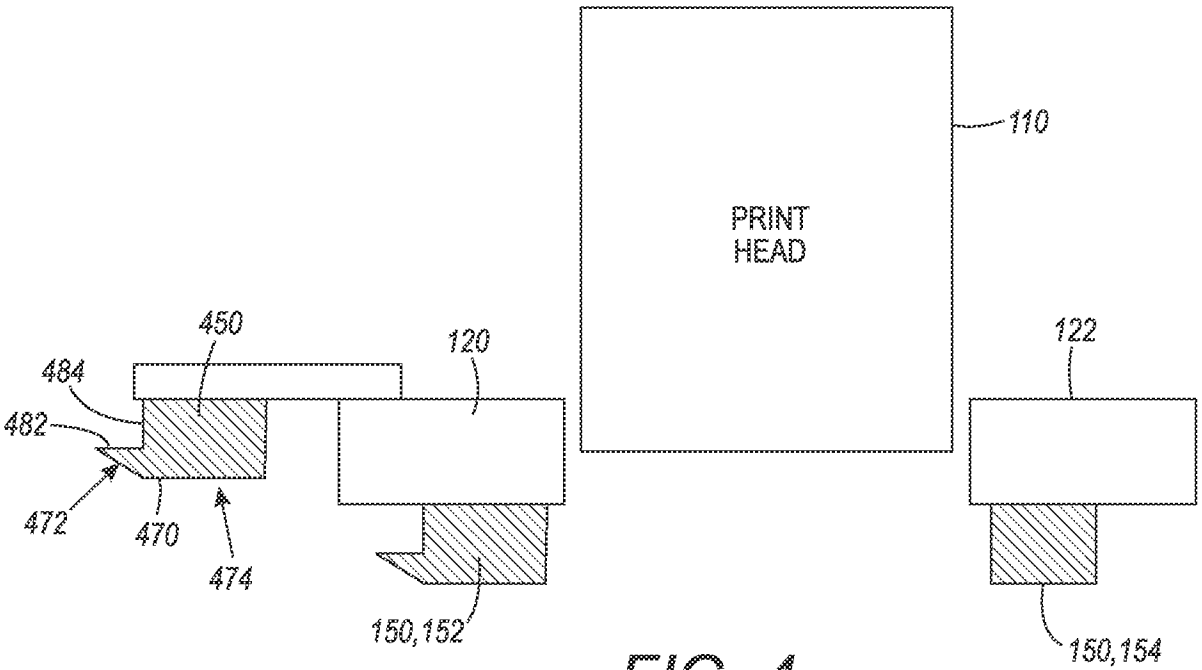
FIG. 4 depicts a cross-sectional view of the print head including another illustrative spacer, according to one or more embodiments disclosed.

FIG. 4 depicts a cross-sectional view of the print head 110 including another illustrative spacer 450, according to one or more embodiments disclosed. A second spacer 450 may be coupled to or integral with the first spacer 150 or the mounting plate 120. The second spacer 450 may include first, second, and third surfaces 470, 482, 484 that are similar to those of the first spacer 150.

The second spacer 450 may be positioned upstream from the first spacer 150 with respect to the direction 132 that the transport belt 130 moves. In addition, the second spacer 450 may be positioned farther from the transport belt 130 than the first spacer 150. For example, a distance between the second spacer 450 (e.g., the parallel portion 474 of the first surface 470) and the transport belt 130 may be from about 1 mm to about 5 mm. More generally, the parallel portion surface 474 may be any amount vertically above parallel portion surface 174 and vertically less than or equal to the maximum expected height of paper 140, 142, or 144 shown in FIG. 3.

Figure 5:
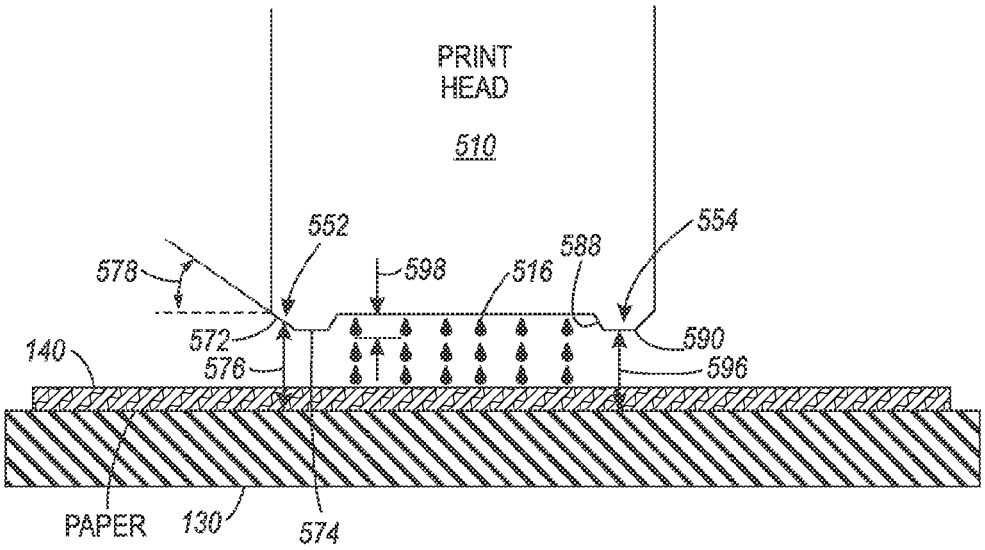
FIG. 5 depicts a cross-sectional view of the print head having the spacer integrated therewith, according to one or more embodiments disclosed.

FIG. 5 depicts a cross-sectional view of a print head 510 having the spacer (e.g., first and second spacers 552, 554) integrated therewith, according to one or more embodiments disclosed. The first spacer 552 may be positioned upstream from the jets (not shown in FIG. 5; see FIG. 2) through which the ink 516 is ejected. The first spacer 552 may have a first sloped portion 572 and a first parallel portion 574. The first sloped portion 572 may ramp or slant toward the transport belt 130 moving in the direction 132. More particularly, a distance 576 between the first sloped portion 572 and the transport belt 130 may decrease moving in the direction 132. As such, the first sloped portion 572 may be oriented at an angle 578 with respect to the transport belt 130. The angle 578 may be from about 10° to about 80°, about 20° to about 70°, or about 30° to about 60°.

The first parallel portion 574 may be downstream from the first sloped portion 572. The first parallel portion 574 may be substantially parallel to the transport belt 130. A distance between the first parallel portion 574 and the transport belt 130 may be from about 0.1 mm to about 0.6 mm or about 0.2 mm to about 0.4 mm.

The second spacer 554 may be positioned downstream from the first spacer 552 and downstream from the jets through which the ink 516 is ejected. The second spacer 554 may have a second sloped portion 588 and a second parallel portion 590. The second sloped portion 588 may also ramp or slant toward the transport belt 130 moving in the direction 532. More particularly, a distance between the second sloped portion 588 and the transport belt 130 may decrease moving in the direction 132. As such, the second sloped portion 588 may be oriented at an angle with respect to the transport belt 130. The angle may be from about 10° to about 80°, about 20° to about 70°, or about 30° to about 60°.

The second parallel portion 590 may be downstream from the second sloped portion 588. The second parallel portion 590 may be substantially parallel to the transport belt 130. A distance 596 between the second parallel portion 590 and the transport belt 130 may be from about 0.1 mm to about 0.6 mm or about 0.2 mm to about 0.4 mm. A distance 598 between the first parallel portion 574 (or the second parallel portion 590) and the face plate 112 where the jets are located, measured in a direction that is perpendicular to the transport belt 130, may be from about 5 μm to about 900 μm.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" may include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the present teachings have been illustrated with respect to one or more implementations, alterations and/or modifications may be made to the illustrated examples without departing from the spirit and scope of the appended claims. For example, it may be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It may be appreciated that structural objects and/or processing stages may be added, or existing structural objects and/or processing stages may be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items may be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, the terms "exemplary" or "illustrative" indicate the description is used as an example, rather than implying that it is an ideal. Other embodiments of the present teachings may be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A printer, comprising:

a print head including a plurality of jets configured to eject ink;

a transport belt positioned below the print head, wherein the transport belt is configured to move in a direction;

a mounting plate positioned adjacent to the print head and above the transport belt; and a spacer positioned above the transport belt and below the mounting plate, wherein the spacer includes a first surface, and wherein a distance between a portion of the first surface and the transport belt decreases moving in the direction that the transport belt moves, the spacer being positioned closer to the transport belt than the print head, wherein the spacer includes a first side positioned upstream from the plurality of jets and a second side positioned downstream from the plurality of jets with respect to the direction that the transport belt moves and the print head is positioned between the first side and the second side of the spacer.

2. The printer of claim 1, wherein the spacer is coupled to or integral with the print head.

3. The printer of claim 1, wherein the portion of the first surface is substantially planar and oriented at an angle with respect to the transport belt from about 10° to about 80°.

4. The printer of claim 1, wherein the portion of the first surface is curved.

5. The printer of claim 1, wherein a shortest distance between the first surface of the spacer and the transport belt is less than or equal to 50% of a shortest distance between the print head and the transport belt.

6. The printer of claim 1, wherein the spacer further includes a second surface that is positioned above the first surface, and wherein the second surface is substantially parallel to the transport belt.

7. The printer of claim 6, wherein the spacer further includes a third surface that is positioned above the second surface, and wherein the third surface is substantially perpendicular to the transport belt.

8. The printer of claim 1, wherein the spacer is positioned upstream from the jets.

9. The printer of claim 1, wherein the spacer is configured to prevent a piece of paper that extends upward from the transport belt more than a predetermined amount from passing under the print head.

10. A printer, comprising:

a print head including a plurality of jets configured to eject ink;

a transport belt positioned below the print head, wherein the transport belt is configured to move in a direction;

a first mounting plate positioned adjacent to the print head on a first side and above the transport belt;

a second mounting plate positioned adjacent to the print head on a second side and above the transport belt; and a first spacer positioned above the transport belt and below the first mounting plate, wherein the first spacer includes a first side positioned upstream from the jets and a second side positioned downstream from the jets with respect to the direction that the transport belt moves and the print head is positioned between the first side and the second side of the first spacer, wherein the first side includes a first surface, and wherein a distance between a portion of the first surface and the transport belt decreases moving in the direction that the transport belt moves, the first spacer being positioned closer to the transport belt than the print head.

11. The printer of claim 10, wherein the portion of the first surface is substantially planar and oriented at an angle with respect to the transport belt from about 10° to about 80°, and wherein a shortest distance between the first surface of the first spacer and the transport belt is less than or equal to 50% of a shortest distance between the print head and the transport belt.

12. The primer of claim 10, wherein the first space further includes a second surface that is positioned above the first surface, wherein the second surface is substantially parallel to the transport belt, wherein the first spacer further includes a third surface that is positioned above the second surface, and wherein the third surface is substantially perpendicular to the transport belt.

13. The printer of claim 10, wherein the second side of the first spacer includes a second surface, and wherein, a distance between a portion of the second surface and the transport belt decreases moving in the direction that the transport belt moves.

14. The printer of claim 10, further comprising a second spacer positioned upstream from the first spacer with respect to the direction that the transport belt moves, wherein a shortest distance between the second spacer and the transport belt is greater than the shortest distance between the first surface of the first spacer and the transport belt.

15. A method for printing, comprising;

causing a piece of paper to be placed onto a transport belt in a printer, wherein the transport belt moves in a direction in the printer, and wherein the printer comprises:

a print head including a plurality of jets configured to eject ink, wherein the transport belt is positioned below the print head;

a mounting plate positioned adjacent to the print head and above the transport belt; and a spacer positioned above the transport belt and below the mounting plate, wherein the spacer includes a first surface, and wherein a distance between a portion of the first surface and the transport belt decreases moving in the direction that the transport belt moves, the spacer being positioned closer to the transport belt than the print head, and wherein the spacer includes a first side positioned upstream from the plurality of jets and a second side positioned downstream from the plurality of jets with respect to the direction that the transport belt moves and the print head is positioned between the first side and the second side of the spacer.

16. The method of claim 15, wherein the piece of paper is configured to contact the first surface when a portion of the piece of paper extends upward from the sport belt first predetermined distance.

17. The method of claim 16, wherein the first surface urges the portion of the piece of paper back toward the transport belt, and the piece of paper continues moving in the direction under the print head.

18. The method of claim 17, wherein the spacer further includes a second surface that is positioned above the first surface, and wherein the second surface is substantially parallel to the transport belt, and wherein the spacer further includes a third surface that is positioned above the second surface, and wherein the third surface is substantially perpendicular to the transport belt.

19. The method of claim 18, wherein the piece of paper is configured to contact the second surface, the third surface, or both, when the portion of the piece of paper extends upward from the transport belt a more than the first predetermined distance, thereby causing the piece of paper to jam within the printer.

* * * * *